US006717365B2

(12) United States Patent
Lee et al.

(10) Patent No.: US 6,717,365 B2
(45) Date of Patent: Apr. 6, 2004

(54) MAGNETRON

(75) Inventors: Yong Soo Lee, Seoul (KR); Jong Soo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/372,272

(22) Filed: Feb. 25, 2003

(65) Prior Publication Data

US 2003/0197471 A1 Oct. 23, 2003

(30) Foreign Application Priority Data

Apr. 18, 2002 (KR) ..... P2002-21231
Apr. 18, 2002 (KR) ..... P2002-21232

(51) Int. Cl.[7] ..... H01J 25/50

(52) U.S. Cl. ..... 315/39.51; 315/39.53; 315/39.71

(58) Field of Search ..... 315/39.51, 39.53, 315/39.75, 39.71

(56) References Cited

U.S. PATENT DOCUMENTS 4,426,601 A * 1/1984 Tsuzurahara ..... 315/39.51

* cited by examiner

*Primary Examiner*—David Vu
(74) *Attorney, Agent, or Firm*—Fleshner & Kim, LLP

(57) ABSTRACT

Magnetron including a cylindrical anode having a resonant space formed therein and a cathode fitted therein, magnets fitted to upper and lower sides of the anode, a yoke fitted on outsides of the anode and the magnets to for a closed circuit, and cooling devices including a main cooling device to form a heat discharge path from the anode, and a supplementary cooling device to form a heat discharge path from the magnet direct or indirectly, wherein the main cooling device is an anode heat conductor having one end closely fitted to an outside surface of the anode, and the other end passed to the yoke and exposed to an external air, and the supplementary cooling device includes a magnet heat conductor closely fitted to an outside surface of the magnet, the magnet heat conductor having one side in contact with the outside case of the magnetron, or a yoke heat conductor closely fitted to an outside surface of a yoke plate, the yoke heat conductor having one side in contact with the outside case of the magnetron.

23 Claims, 14 Drawing Sheets

MAGNETRON

This application claims the benefit of the Korean Application Nos. P2002-21231, and P2002-21232, both filed on Apr. 18, 2002, which are hereby incorporated by reference.

BACKGROUND OF THE INVENTION

1. Field of the Invention

The present invention relates to a magnetron having an improved self-cooling performance.

2. Background of the Related Art

In general, the magnetron has applications in microwave ovens, plasma lighting fixtures, dryers, and other microwave systems.

The magnetron, a kind of vacuum tube, emits a thermal electron from a cathode thereof as a power is applied thereto, and the thermal electron emits a microwave by action of strong electric, and magnetic fields. The microwave is forwarded through an antenna, or a feeder, and used as a heat source for heating an object.

In general, the magnetron is provided with an oscillating part and a magnetic circuit part for generating the microwave, an input part for receiving and providing a power to the oscillating part, an output part for forwarding the microwave generated by the oscillating part and the magnetic circuit part, and a cooling part for cooling the magnetron, of which detailed system will be described with reference to FIG. 1. FIG. 1 illustrates a related art magnetron.

Referring to FIG. 1, there are elements of the input and output parts in upper and lower parts of a yoke 1 which forms a magnetic closed circuit as a part of the magnetic circuit part, and there are elements of the oscillating part and the magnetic circuit part inside of the yoke 1.

The oscillating part has an anode 11 and a cathode 16. As shown in FIG. 1, the anode 1 is cylinder fitted to a center of the yoke 1. On an inside surface of the anode 11, there are a plurality of vanes 15 fitted in a radial direction toward a center of the anode 11, to form a interaction space 15*a* at the center of the anode 11 the vanes 15 and spaces between the vanes 15 inside of the anode 11 form resonance cavities. There is a cathode 16 of a filament fitted in the interaction space 15*a*, with a center lead 17*a* and a side lead 17*b* for receiving a power.

The magnetic circuit part is provided with one pair of magnets 12*a* and 12*b*, one pair of magnetic poles 13*a* and 13*b*, and a yoke 1. As shown in FIG. 1, there is one pair of magnets 12*a* and 12*b*; an upper magnet 12*a* over the anode 11 and a lower magnet 12*b* under the anode 11. Both the upper magnet 12*a* and a lower magnet 12*b* are hollow, each for leading an antenna feeder 32, a center lead 17*a*, and a side lead 17*b* to outward. There are also one pair of magnetic poles 13*a* and 13*b*; an upper magnetic pole 13*a* between an upper side of the anode 11 and the upper magnet 12, and a lower magnetic pole 13*b* between a lower side of the anode 11 and a lower magnet 12*b*. The upper magnetic pole 13*a* and the lower magnetic pole 13*b* is fitted perpendicular to axes of the anode 11 and the cathode 16. The yoke 1 has a yoke upper plate 1*a* and a yoke lower plate 1*b*, which are joined together to form the magnetic closed circuit.

In the meantime, for keeping an air tightness and vacuum of the inside space of the magnetron, the magnetron is provided with components, such as an A seal 14*a*, F seal 14*b*, an upper end shield 18*a*, and a lower end shield. The A seal 14*a*, and the F seal 14*b* of cylindrical metal containers are fitted between a top part of the anode 11 and the output part, and a bottom part of the anode 11 and the input part, for maintaining sealing. For fitting the A seal 14*a* and the F seal 14*b* as shown in FIG. 1, it is required that the upper magnet 12*a* and the lower magnet 12*b* are inserted to outer circumferential surfaces of the A seal 14*a* and the F seal 14*b* respectively. An opened bottom part of the F seal 14*b* is closed by a ceramic stem 21. As shown in FIG. 1, the upper end shield 18*a* and the lower end shield 18*b* are also fitted to top and bottom ends of the cathode 16.

The input part has a condenser 23 and a choke coil 23*a*. For preventing leakage of the microwave from the oscillating part, and protecting the choke coil 23*a* and a ceramic system 21, there is a filter box 22 fitted under the yoke 1 where the input part is fitted. There is a condenser 23 at one side of the filter box 22, and the choke coil 23*a* is fitted inside of the filter box 22 so as to be connected with the condenser 23. There are one pair of external connection leads 23*b* from the choke coil 23*a*, passed through a ceramic system 21 and connected to the center lead 17*a* and the side lead 17*b*.

The output part has an antenna feeder 32, an A ceramic 31, an antenna cap 33. The antenna feeder 32 has one end connected to the vane 15, and the other end extended trough the magnet 12 to an outer upper side of the yoke 1. As shown in FIG. 1, the A fitted to top of the A seal 14*a*, and the antenna cap 33 is on the A ceramic 31, surrounding an end of the antenna feeder 32.

The cooling part 34 has cooling fins 34 and a cooling fan (not shown). The cooling fin 34 has one end connected to an outside surface of the anode 11, and the other end connected to an inside surface of the yoke 1. The cooling fan is fitted to an outside of the yoke 1 for blowing external air toward the yoke 1. To do this, there are an inlet (not shown) and an outlet (not shown) in an outside case (not shown) of the magnetron for drawing and discharging the external air therethrough by using the cooling fan.

The operation of the magnetron will be described.

When power is provided to the oscillating part through the input part, thermal electrons are emitted from the cathode 16 to the interaction space 15*a*, where a magnetic field formed by one pair of the magnets 12*a* and 12*b* is focused through the one pair of magnetic poles 13*a* and 13*b*. According to this, the thermal electrons in the interaction space 15*a* are made to circulate by the magnetic field, such that the microwave is generated as oscillation of the thermal electrons is kept excited as the thermal electrons are synchronized to the resonance spaces of the anode 11.

The microwave generated thus is transmitted through the antenna feeder 32 extended from the vane 15 to an outside, and emitted to outside through the A ceramic 31 and the antenna cap 33. The microwave emitted to outside of the magnetron cooks or warms up food when the magnetron is applied to a microwave oven, and emits light by exciting plasma when the magnetron is applied to lighting fixtures or the like.

In the meantime, a microwave energy which fails in emission to outside of the anode 11 after being generated in the oscillating part is dissipated as heat, which is dissipated by the cooling fin 34 and the cooling fan to outside of the anode 11. That is, the heat is transmitted from the anode 11 to the yoke 1 through the plurality of cooling fins 34, and the heat transmitted to the yoke 1 is heat exchanged with external air blown by the cooling fan, to dissipate the heat and cool down the magnetron.

However, not all the heat from the anode 11 is dissipated through the cooling fin 34 and the cooling fan, but a portion thereof is transmitted to the magnets 12*a* and 12*b* adjacent thereto. Because the magnets 12*a* and 12*b* on a direct heat transmission path from the anode 11 have no other heat dissipation path, the magnets 12*a* and 12*b* are involved in heating to a temperature similar to the anode 11. The long time exposure of the magnets 12*a* and 12*b* to a high temperature affects an intensity of the magnetic field and the magnetic circuit, which cause power drift of the magnetron.

When the magnetron is cooled down with the cooling fan, the cooling fan generates noise and vibration when in operation, and the cooling fan requires a fitting space, that makes the magnetron larger.

The outside case requires the inlet and the outlet for introduction and discharge of the external air to/from the outside case. If the magnetron is applied to a product to be disposed in outdoor such as a light fixture, the inlet/outlet in the outside case may allow rain, dusts, and insects to enter therein, which may cause operative problem and frequent trouble of the magnetron.

SUMMARY OF THE INVENTION

Accordingly, the present invention is directed to a magnetron that substantially obviates one or more of the problems due to limitations and disadvantages of the related art.

An object of the present invention is to provide an excellent air cooling type magnetron in which heat dissipation paths of an anode and magnets are formed together.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the magnetron includes a cylindrical anode having a resonant space formed therein and a cathode fitted therein, magnets fitted to upper and lower sides of the anode, a yoke fitted on outsides of the anode and the magnets to form a closed circuit, and cooling devices including a main cooling device to form a heat discharge path from the anode, and a supplementary cooling device to form a heat discharge path from the magnet direct or indirectly.

The main cooling device is an anode heat conductor having one end closely fitted to an outside surface of the anode, and the other end passed to the yoke and exposed to an external air.

The supplementary cooling device includes a magnet heat conductor closely fitted to an outside surface of the magnet, having one side in contact with the outside case of the magnetron, a yoke heat conductor closely fitted to an outside surface of a yoke plate, the yoke heat conductor having one side in contact with the outside case of the magnetron, or a magnet heat conductor closely fitted to an outside surface of the magnet, the magnet heat conductor having one side in contact with the outside case of the magnetron, and a yoke heat conductor closely fitted to an outside surface of a yoke plate, the yoke heat conductor having one side in contact with the outside case of the magnetron.

The anode heat conductor includes a head closely fitted to an outside surface of the anode, an extension from the head to pass through the yoke, and a heat dissipation plate connected to an outside end of the extension and exposed to external air, or a head closely fitted to an outside surface of the anode, a heat pipe having one end closely fitted to the head, and the other end passed through the yoke to be positioned at an exterior, and a heat dissipation plate connected to an outside end of the heat pipe and exposed to external air. Both ends of the heat pipe are inserted in the head and the heat dissipation plate, respectively.

The head includes at least two members for detachably fitting to surround an outside surface of the anode.

The magnetron further includes a heat transmission material applied to a part the outside surface of the anode is in contact with the head. The heat transmission material is a grease, or a paste.

The heat dissipation plate includes a plurality of heat dissipation fins fitted thereto. The heat dissipation fin is a thin and long plate.

The heat dissipation plate forms one face of the outside case. The heat dissipation fin is a thin and long plate fitted to an outside surface of the outside case.

The magnetron further including insulating members fitted between both ends of the anode and the magnets, and between the magnets and the yoke.

The insulating member is formed of mica or asbestos, in a form of a disk or polygonal plate having a hole in a central part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, the same parts will be given the same names and reference symbols, and repetitive descriptions of which will be omitted.

The magnetron of the present invention includes an oscillating part having a resonant space therein and a cylindrical anode 11 with a cathode fitted therein; a magnetic circuit part having one pair of magnets 12*a* and 12*b* over and under the anode 11, and a yoke 1 on outsides both of the anode 11 and the magnets 12*a* and 12*b* to form a magnetic closed circuit; an input part for applying power to the oscillating part; ordinary components for maintaining air tightness of the magnetron; an output part for forwarding the microwave generated by the oscillating part and the magnetic circuit part to outside of the magnetron; and cooling devices having a main cooling device and a supplementary cooling device for cooling down the magnetron.

Because other components of the magnetron of the present invention except the cooling devices are the same with the related art, components of the present invention identical to the related art will be given the same reference symbols, and the present invention will be described focused on a structure and function of the cooling devices while structural details and functions of other components are omitted for avoiding repetition.

The cooling devices include a main cooling device forming a heat discharge path of the anode 11 for cooling down the anode 11, and a supplementary cooling device forming a heat discharge path of the magnets 12*a* and 12*b* or the yoke 1 for cooling the magnets 12*a* and 12*b* directly or indirectly. There may be a variety of embodiments of the present invention depending on systems of the main cooling device and the supplementary cooling device and how the main cooling device and the supplementary cooling device are combined, of which typical embodiments will be described with reference to the attached drawings.

Figure 1:
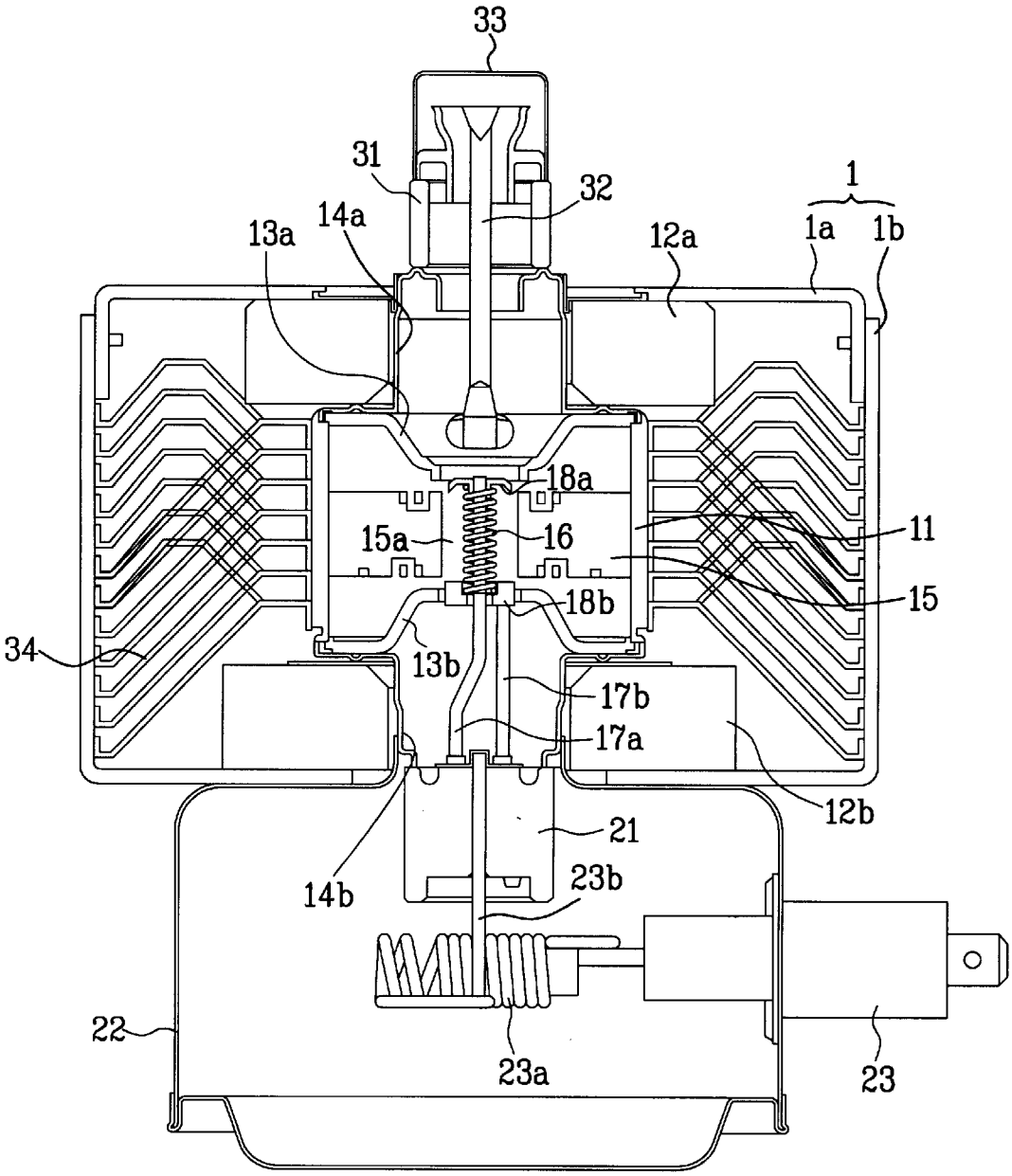
FIG.1 Prior Art
FIG. 1 illustrates a diagram of a related art magnetron.
Figure 2:
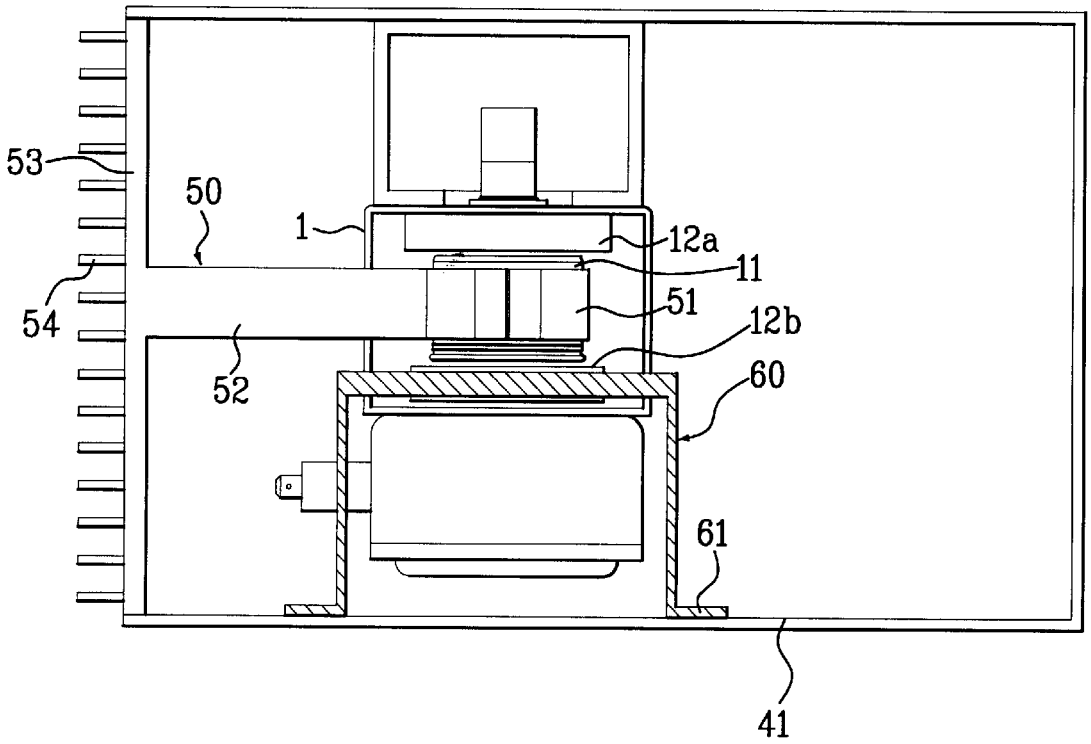
FIG. 2 illustrates a diagram of a magnetron in accordance with a preferred embodiment of the present invention.

Referring to FIG. 2, the main cooling device includes the anode heat conductor 50, and the supplementary cooling device includes a magnet heat conductor 60.

The anode heat conductor 50 has one side part closely fitted to an outside surface of the anode 11, and the other side part passed through the yoke 1 and exposed to an outside air. Typical two preferred embodiments of the anode heat conductor 50 mounted thus will be explained, with reference to the attached drawings.

Figure 3A:
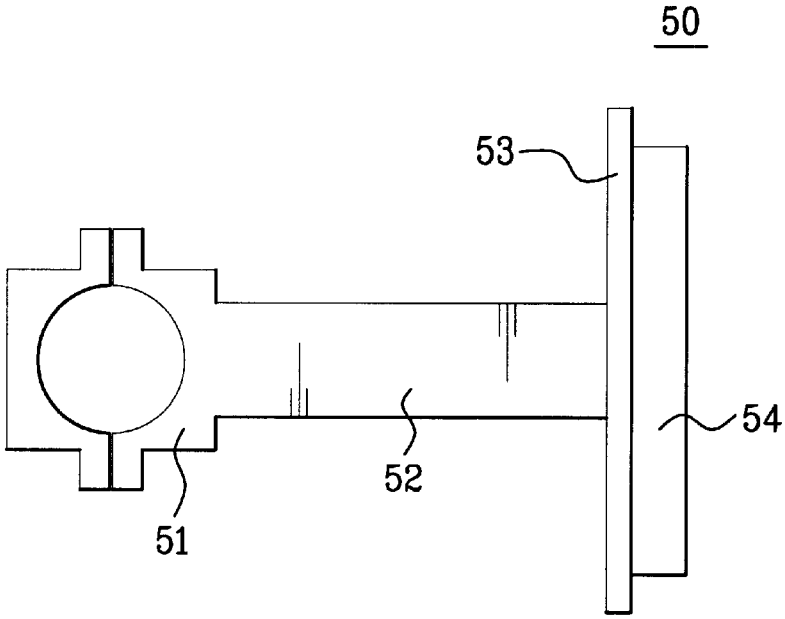
FIG. 3A illustrates a plan view of the anode conductor in FIG. 2.

Referring to FIG. 3A, the anode heat conductor 50 includes a head 51, an extension 52, and a heat dissipation plate 53. The head 51 is closely fitted to an outside circumference of the cylindrical anode 11. As shown in FIG. 3A, the head 51 has at least two members for easy attachment/detachment to/from the outside circumference of the anode 11. The extension 52 is extended from the head 51 to pass the yoke 1. The heat dissipation plate 53 is a plate connected to an end of the extension 52 at outside of the yoke 1 so as to be exposed to outside air. The anode heat conductor 50 is formed of a material having a good heat conductivity, such as copper.

Figure 3B:
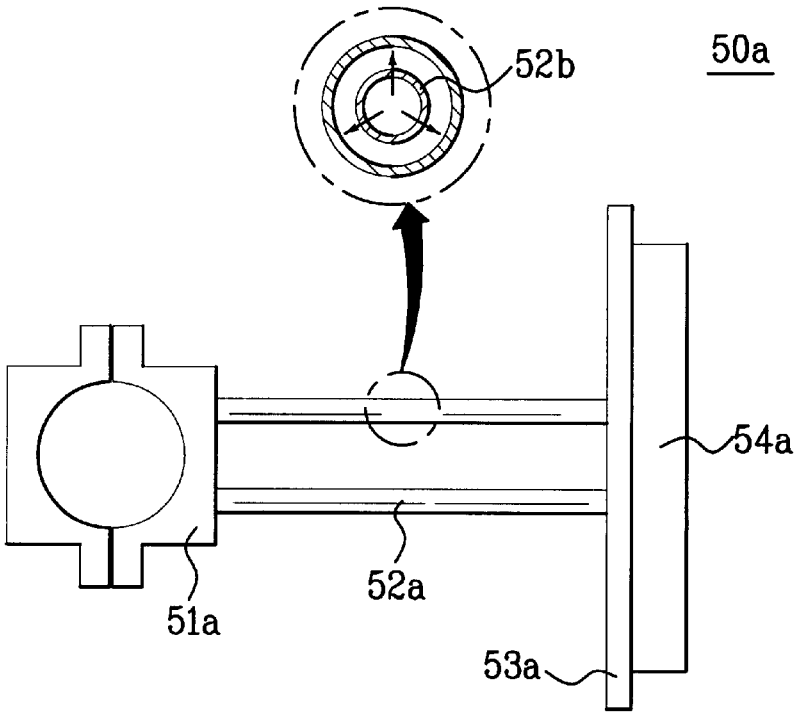
FIG. 3B illustrates a plan view of another preferred embodiment of the anode conductor in FIG. 2.

Referring to FIG. 3B, an anode heat conductor 50*a* includes a head 51*a*, a heat pipe 52*a*, and a heat dissipation plate 53*a*. Since structures of the head 51*a* and the heat dissipation plate 53*a* are similar to the anode heat conductor 50 described in association with FIG. 3A, description of which will be omitted. The heat pipe 52*a* passes the yoke such that one end thereof is closely fitted to the head 51*a* and the other end thereof is passed through the yoke 1 to an exterior, and connected to the heat dissipation plate 53*a*.

The heat pipe 52*a* is an ordinary heat pipe having capillary tubes each with a wick 52*b* provided therein for circulating a working fluid of good volatility. Operation principle of the heat pipe 52*a* will be described, briefly.

The heat pipe 52*a* hap the working fluid of a liquid state inside of the wick 52*b* flowing in a direction from the heat dissipation plate 53*a* to the head 51*a*. Then, the working fluid flows to an outside of the wick 52*b* along the capillary tube while the working fluid heat exchanges with the head 51*a* and vaporizes, and flows toward the heat dissipation plate 53*a* along the outside of the wick 52*b*. The working fluid of a gas state reached to the heat dissipation plate 53*a* is changed to the working fluid of a liquid state as the working fluid of a gas state heat exchanges with the heat dissipation plate 53*a*, and flows toward the head 51*a* through an inside of the wick 52*b* again.

The heat pipe 52*a* has an excellent heat transfer efficiency better than an ordinary heat transfer in which the heat exchange is made by simple conduction or convection because the working fluid absorbs or discharges heat from/to environments while the working fluid is involved in a phase change. Therefore, the heat pipe 52*a* in the anode heat conductor 50*a* enhances the cooling capability.

The heat pipe 52*a* may be formed such that both ends thereof are inserted in the head 51*a* and the heat dissipation plate 53*a* for enhancing the heat transfer.

An ordinary heat transmission material, such as grease and paste, is applied to a part the head 51 or 51*a* of the anode heat conductor 50 or 50*a* and the outside surface of the anode 11 are in contact for improving the heat transfer.

As shown in FIGS. 2, 3A and 3B, the heat dissipation plate 53 or 53*a* of the anode heat conductor 50 or 50*a* includes a plurality of heat dissipation fins 53 or 53*a* for enhancing a heat dissipation capability. The fin 54 or 54*a* is a thin and long plate fitted to the heat dissipation plate 53 or 53*a* in a vertical direction.

Alternatively, as shown in FIG. 2, for enhancing a cooling efficiency of the heat dissipation plate 53 or 53*a* of the anode heat conductor and reducing a size of the magnetron, the heat dissipation plate 53 or 53*a* itself is made to be one face of the outside case of the magnetron, when the thin and long plates of the heat dissipation fins 54 or 54*a* are attached to an outside surface of the outside case 41.

In the meantime, referring to FIG. 2, the magnet heat conductor 60 is closely fitted to an outside surface of the magnet 12*a* or 12*b*, with one side of the magnet heat conductor 60 in contact with the outside case 41 of the magnetron. For making an easy contact of the one side of the magnet heat conductor 60 to the outside case 41 of the magnetron, the magnet heat conductor 60 has a flange 61 at one end of the one side thereof. The magnet heat conductor 60 forms a heat discharge path of the magnet 12*a* or 12*b*, and formed of a material having an excellent heat conductivity, such as copper, for obtaining an excellent cooling capability.

Figure 4:
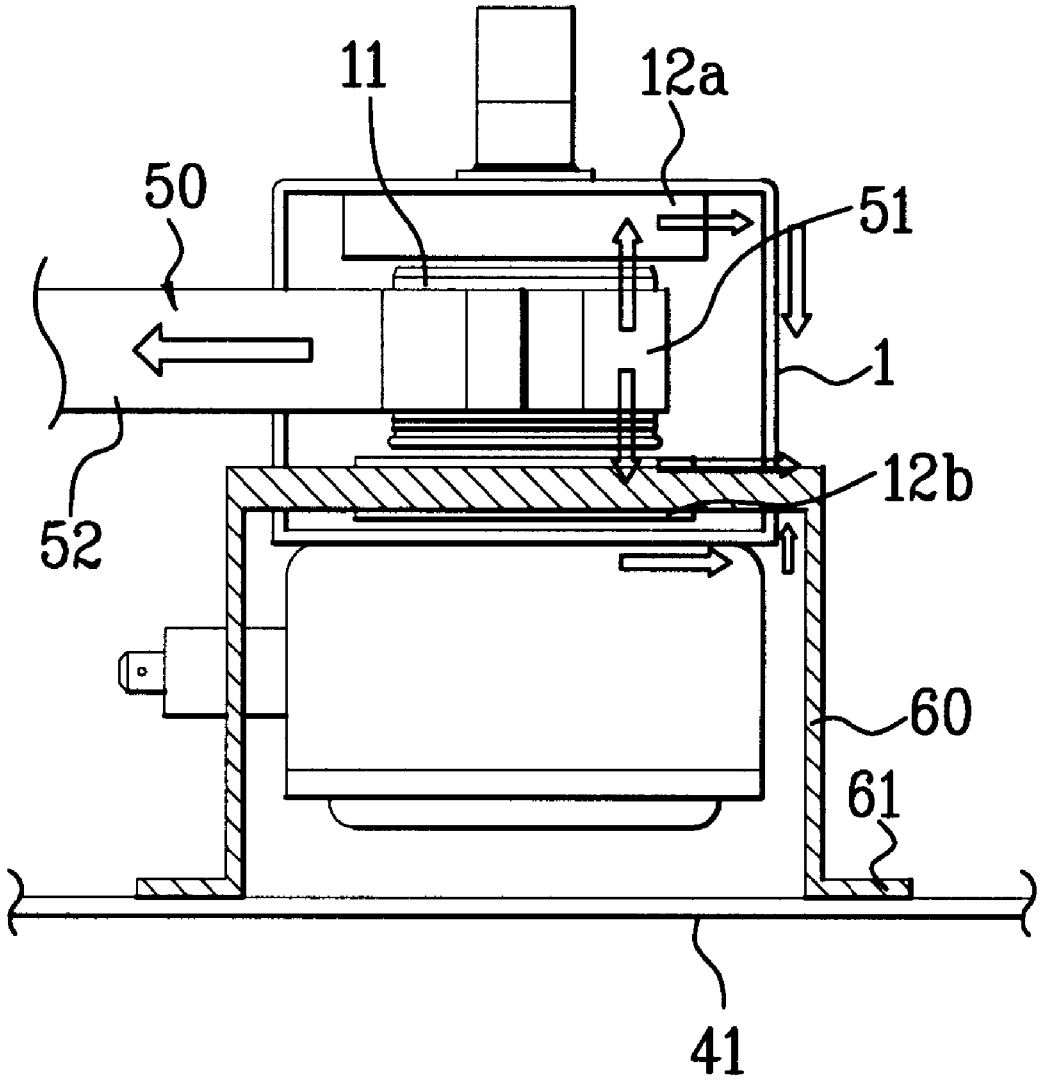
FIG. 4 illustrates a diagram of a heat discharge path in FIG. 2.

The heat discharge path of the preferred embodiment of the present invention will be described with reference to FIG. 4.

Most of the heat is transferred from the anode 11 to the heat dissipation plate 53 quickly through the anode heat conductor 50, to cool down the anode 11 as the plurality of heat dissipation fins 54 on the heat dissipation plate 53 make heat exchange with naturally circulating air by convection to dissipates the heat.

Along with this, a portion of the heat is transferred from the anode 11 to the magnet 12*a* or 12*b* fitted to top and bottom of the anode 11. The heat transferred to the magnet 12*a* or 12*b* is in turn transferred to the outside case 41 through the magnet heat conductor 60, and the outside case 41 makes heat exchange with naturally circulating air by convention to cool down the magnet 12*a* or 12*b*.

Because the anode heat conductor 50 and the magnet heat conductor 60 are provided, to transfer a portion of heat transferred to the magnet 12*a* or 12*b* from the anode 11 to the outside case 41 through the magnet heat conductor 60, the cooling capability is significantly excellent compared to the related art. The cooling capability of the magnetron of the present invention and the cooling capability of the magnetron of the related art will be described with reference to FIGS. 5A and 5B. The comparative graphs in FIGS. 5A and 5B are obtained by measuring temperatures of relevant parts of test sets of enclosed type magnetrons each operated continuously keeping heat loss from the anode to be 90W in total until the temperatures of the relevant parts are saturated.

Figure 5A:
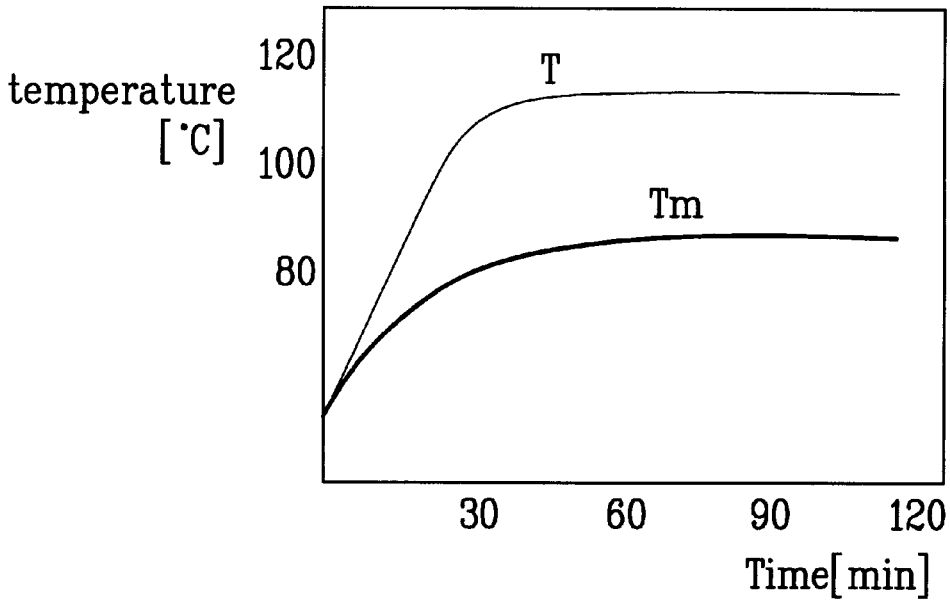
FIG. 5A illustrates a graph comparing a temperature difference of anodes of the related art and the first preferred embodiment of the present invention.
Figure 5B:
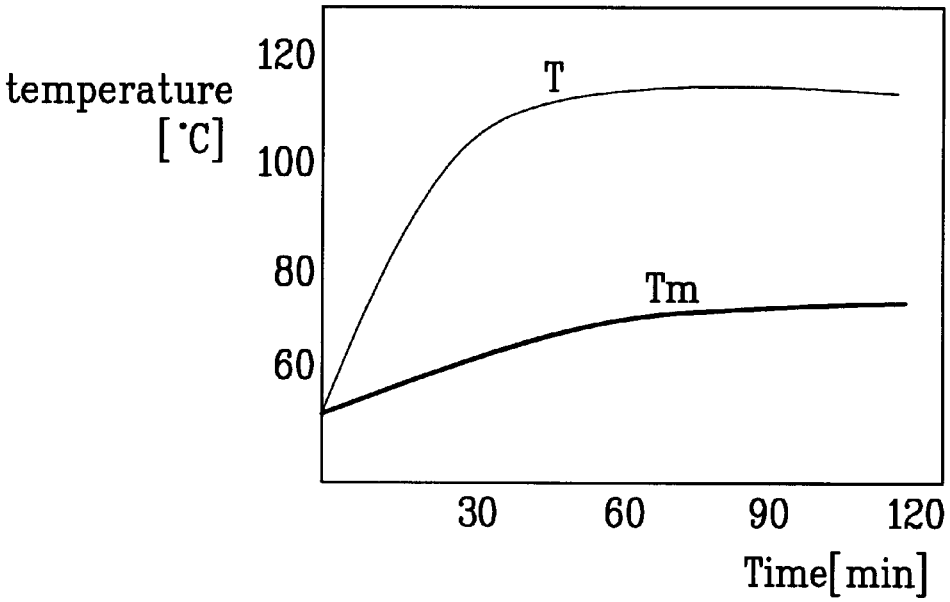
FIG. 5B illustrates a graph comparing a temperature difference of magnets of the related art and the first preferred embodiment of the present invention.

FIG. 5A illustrates a graph comparing a temperature difference of anodes of the related art and one preferred embodiment of the present invention.

Referring to FIG. 5A, it can be known that the temperature T of the anode 11 of the test set of the related art magnetron which has no separate heat discharge path for cooling down the magnets 12*a* and 12*b* rises sharply for a certain time period until the temperature reaches to a saturated state at 120° C. In comparison to this, it can be known that the temperature Tm of the anode 11 of the test set of the magnetron in accordance with a preferred embodiment of the present invention rises moderately for a certain time period until the temperature reaches to a saturated state at a temperature below 100° C.

As a result of the test, it can be known the temperature of the anode 11 is significantly lower than the related art too owing to the heat transfer through the magnet heat conductor 60 too.

FIG. 5B illustrates a graph comparing a temperature difference of magnets of the related art and one preferred embodiment of the present invention.

Referring to FIG. 5B, it can be known that the temperature T of the magnets 12*a* and 12*b* of the test set of the related art magnetron which has no separate heat discharge path for cooling down the magnets 12*a* and 12*b* rises sharply for a certain time period until the temperature reaches to a saturated state in the vicinity of 120° C. which is a saturation temperature of the anode 11. Opposite to this, in comparison to this, it can be known that the temperature Tm of the magnet 12*a* or 12*b* of the test set of the magnetron in accordance with a preferred embodiment of the present invention rises very moderately for a certain time period until the temperature reaches to a saturated state at a low temperature below 80° C.

As a result of the test, it can be known the temperature of the magnet 12*a* or 12*b* having the magnet heat conductor 60 has almost no thermal load.

Accordingly, the magnetron in accordance with one preferred embodiment of the present invention, not only prevents degradation of the magnets 12*a* and 12*b*, but also prevents a magnetic field characteristic change, power drift and reduced lifetime of the magnetron caused by the degradation of the magnets 12*a* and 12*b* in advance.

In the meantime, the supplementary cooling device may be a yoke plate heat conductor 70, such an embodiment will be described with reference to FIG. 6.

Figure 6:
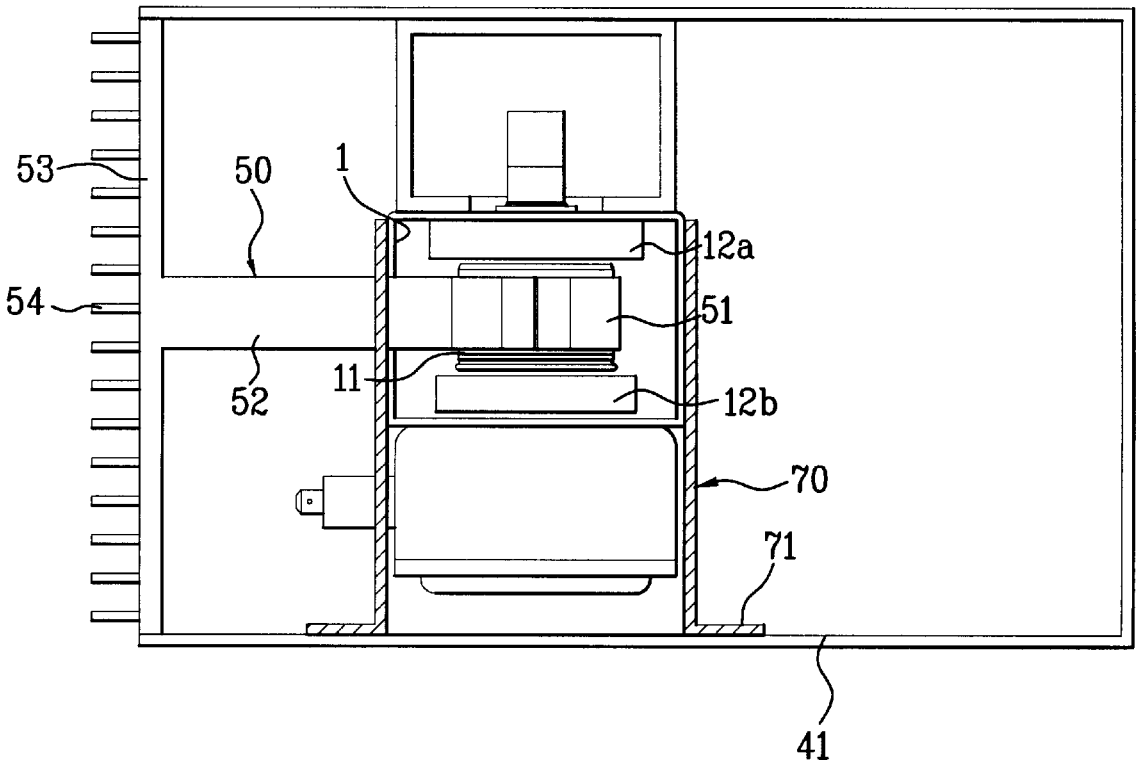
FIG. 6 illustrates a diagram of a magnetron in accordance with another preferred embodiment of the present invention.

Referring to FIG. 6, the cooling devices in accordance with another preferred embodiment of the present invention includes a main cooling device of the anode heat conductor 50 and the supplementary cooling device of the yoke plate heat conductor 70. Description of the anode heat conductor 50, the main cooling device, will be omitted as the anode heat conductor 50 is described in detail in the description of the one preferred embodiment of the present invention in association with FIG. 2, and only the yoke plate heat conductor 70 will be described.

Referring to FIG. 6, the yoke plate heat conductor 70 has a part closely fitted to an outside surface of the yoke 1 and another part in contact with the outside case 41 of the magnetron. Another part of the yoke plate heat conductor 70 has also a flange 71 for easy contact with the outside case 41 of the magnetron. The yoke plate heat conductor 70 forms a heat discharge path of the magnets 12*a* and 12*b* indirectly, and is formed of a material having a good heat conductivity, such as copper.

Figure 7:
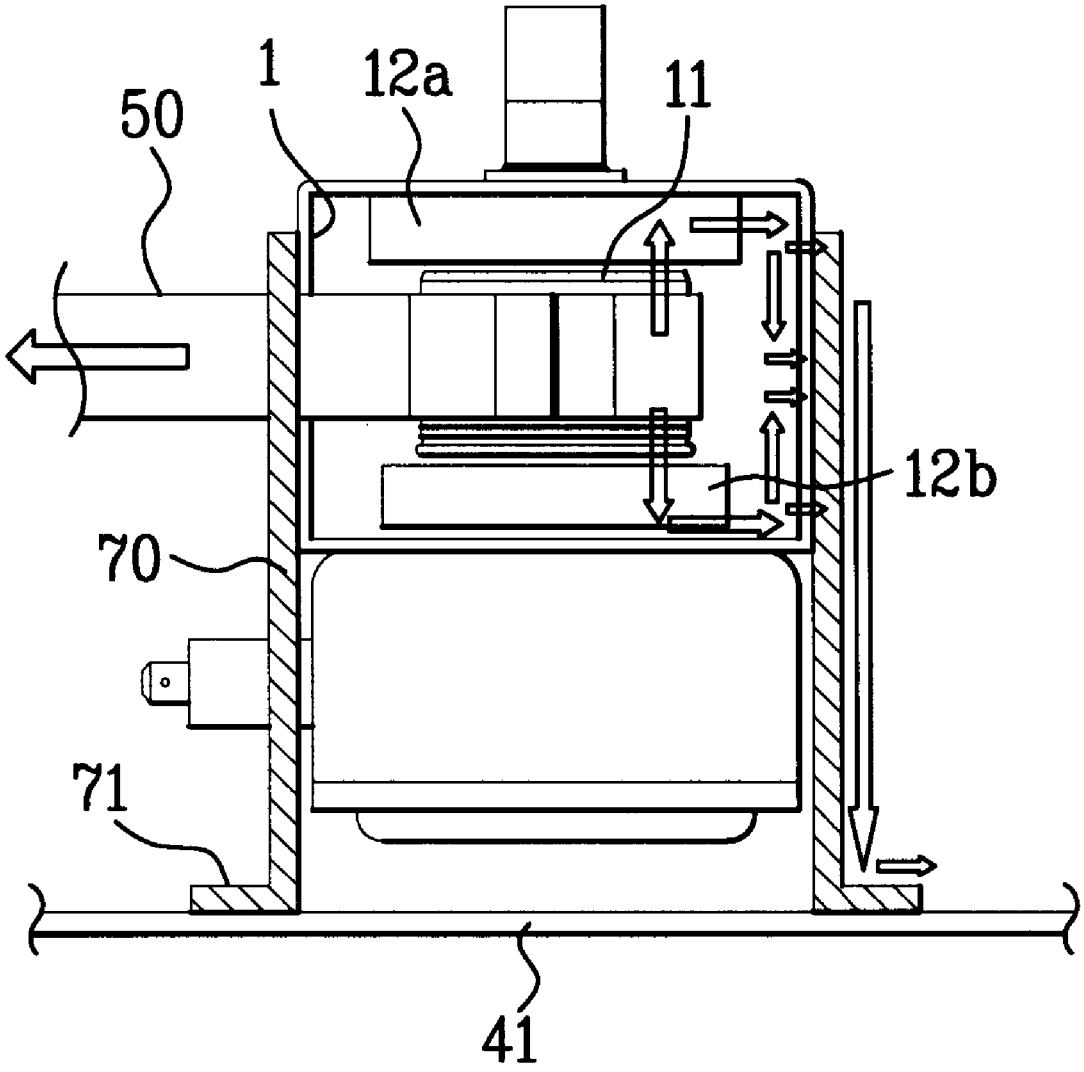
FIG. 7 illustrates a diagram of the heat discharge path in FIG. 6.

A process of heat dissipation in accordance with another preferred embodiment of the present invention will be described with reference to FIG. 7.

Most of the heat is transferred to the heat dissipation plate 53 from the anode 11 through the anode heat conductor 50, to cool down the anode 11 as the plurality of the heat dissipation fins 54 on the heat dissipation plate 53 makes heat exchange with naturally circulating outside air by convection.

Along with this, a portion of the heat is transferred from the anode 11 to the magnets 12*a* and 12*b* on top and bottom of the anode 11, which is then transferred to the yoke 1 adjacent to the magnets 12*a* and 12*b*. Then, as shown in FIG. 6, the heat is transferred from the yoke 1 to the outside case 41 through the yoke heat conductor 70, and dissipated by heat exchange with the naturally circulating air to cool down the magnets 12*a* and 12*b*, indirectly.

Since the heat, generated at the anode 11 and transferred to the magnets 12*a* and 12*b*, is dissipated toward the outside case 41 through the yoke 1 indirectly, the anode heat conductor 50 and the yoke heat conductor 70 provided together enhances a cooling capability in comparison to the related art. The cooling capabilities of the magnetrons of the another embodiment of the present invention and the related art will be described with reference to FIGS. 8A, 8B and 8C. The comparative graphs in FIGS. 8A, 8B and 8C are obtained based on a result of test conducted under the same condition with the comparative graphs in FIGS. 5A and 5B fitting the yoke heat conductor 70 instead of the magnet heat conductor 60.

Figure 8A:
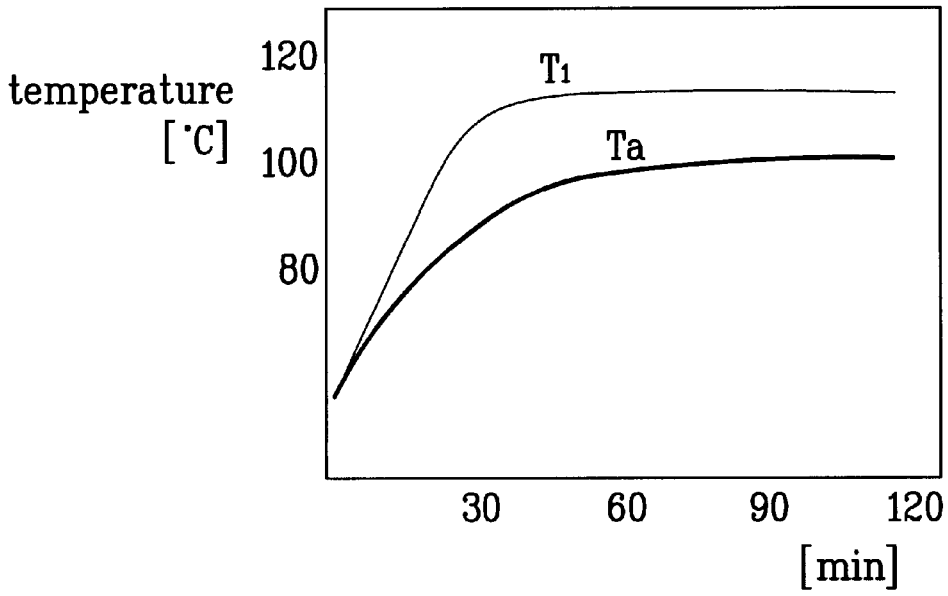
FIG. 8A illustrates a graph comparing a temperature difference of anodes of the related art and another preferred embodiment of the present invention.

FIG. 8A illustrates a graph comparing a temperature difference of anodes of the related art and another preferred embodiment of the present invention.

Referring to FIG. 8A, in the test set of the related art magnetron, it can be known that the anode temperature T1 rises sharply for a certain time period until the anode temperature T1 reaches to a saturated state at approx. 120° C. Opposite to this, in the test set of the magnetron of the another preferred embodiment of the present invention, it can be known that the anode 11 temperature Ta rises moderately for a time period until the anode 11 temperature Ta reaches to a saturated state at approx. 100° C.

Figure 8B:
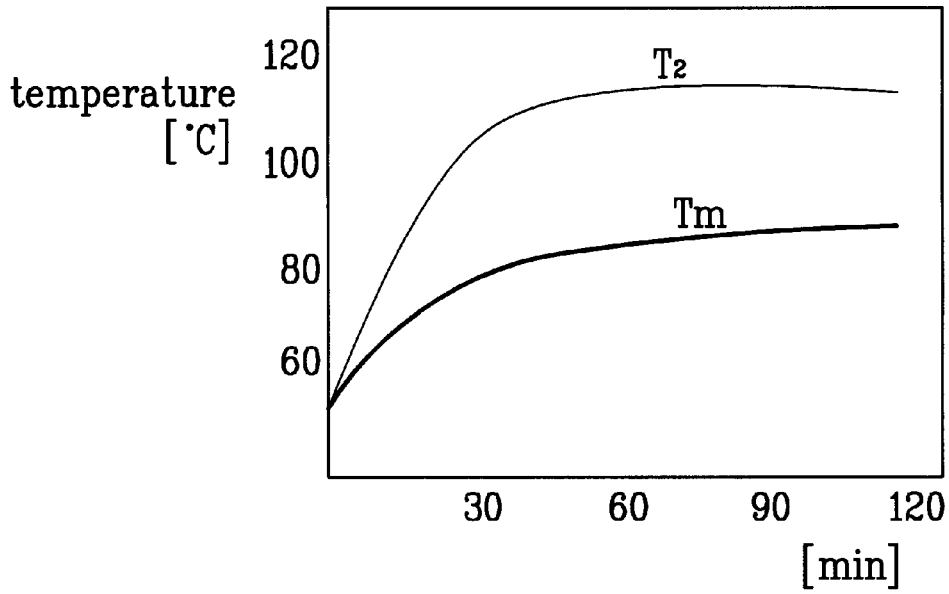
FIG. 8B illustrates a graph comparing a temperature difference of magnets of the related art and another preferred embodiment of the present invention.
Figure 8C:
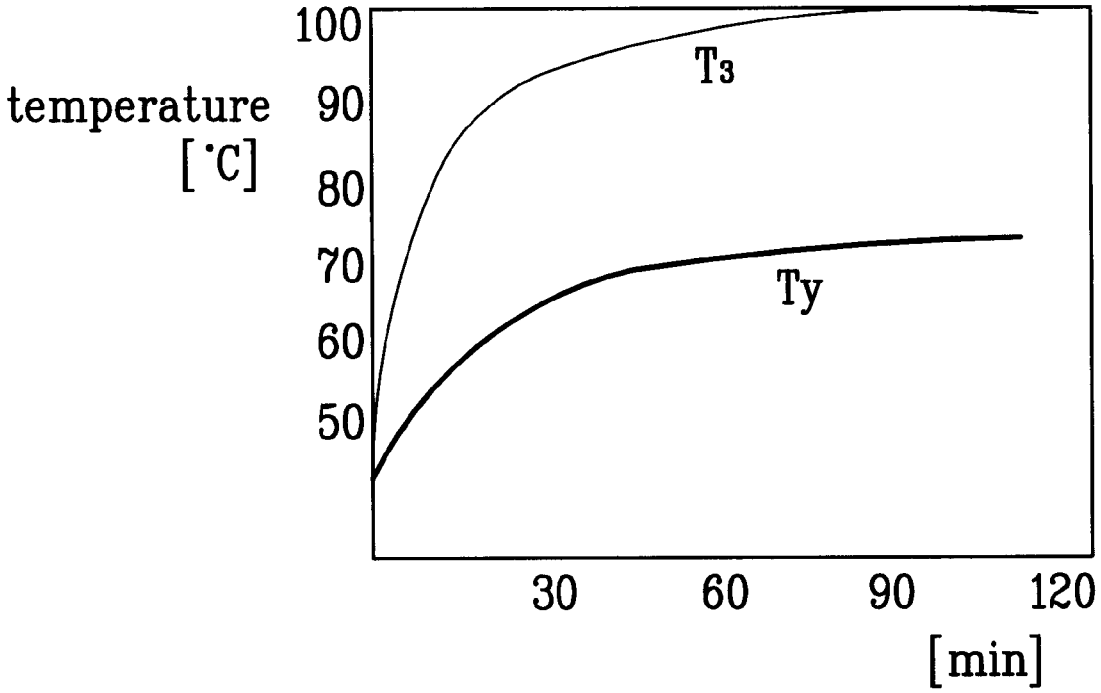
FIG. 8C illustrates a graph comparing a temperature difference of yokes of the related art and another preferred embodiment of the present invention.

FIG. 8B illustrates a graph comparing a temperature difference of magnets of the related art and another preferred embodiment of the present invention.

Referring to FIG. 8B, in the test set of the related art magnetron, it can be known that the magnet temperature T2 rises sharply for a certain time period until the magnet temperature Tm reaches to a saturated state at a temperature below 120° C. Opposite to this, in the test set of the magnetron of the another preferred embodiment of the present invention, it can be known that the magnet 12*a* or 12*b* temperature Tm rises moderately for a time period until the magnet 12*a* or 12*b* temperature Tm reaches to a saturated state at approx. 90° C.

FIG. 8C illustrates a graph comparing a temperature difference of a yokes of the related art and another preferred embodiment of the present invention.

Referring to FIG. 8C, in the test set of the related art magnetron, it can be known that the yoke temperature T3 rises sharply for a certain time period until the yoke temperature T3 reaches to a saturated state at approx. 100° C. Opposite to this, in the test set of the magnetron of the another preferred embodiment of the present invention, it can be known that the yoke 1 temperature Ty rises moderately until the yoke 1 temperature Ty reaches to a saturated state at approx. 70° C.

Eventually, it can be known from above test result that the provision of the yoke heat conductor 70 to the magnetron Facilitates effective cooling of, not only the anode 11 and yoke 1, but also magnets 12*a* and 12*b*, that prevents degradation and performance deterioration caused by exposure of the magnets 12*a* and 12*b* to a high temperature for a long time.

Figure 9:
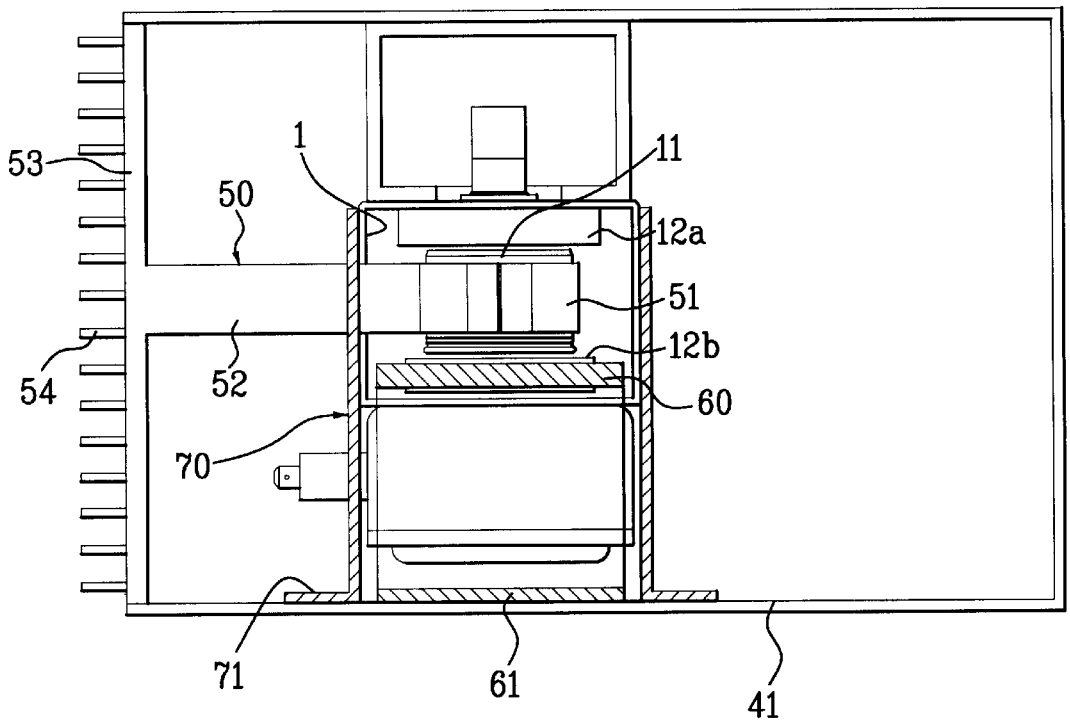
FIG. 9 illustrates a diagram of a magnetron in accordance with another preferred embodiment of the present invention.

Meanwhile, the supplementary cooling device may be fitted both to the magnet heat conductor 60 and the yoke heat conductor 70. Such an embodiment is illustrated in FIG. 9, referring to which, cooling devices in accordance with another preferred embodiment of the present invention includes a main cooling device which is an anode heat conductor 50, and a supplementary cooling device inclusive of magnet heat conductor 60 and a yoke heat conductor 70. Since the anode heat conductor 50, the main cooling device, and the magnet heat conductor 60 and the yoke heat conductor 70, the supplementary cooling device, are identical to the foregoing embodiment, detailed description of which will be omitted. However, as shown in FIG. 9, the provision both of the magnet heat conductor 60 and the yoke heat conductor 70 as the supplementary cooling device assures an adequate cooling capability since more heat discharge paths from the anode 11 are provided, which prevents a reduction of an output of the magnetron caused by degradation of the magnets 12*a* and 12*b*.

Insulating members 55 and 55*a* may be provided between the anode 11 and the magnets 12*a* and 12*b* and the yoke 1.

Figure 10:
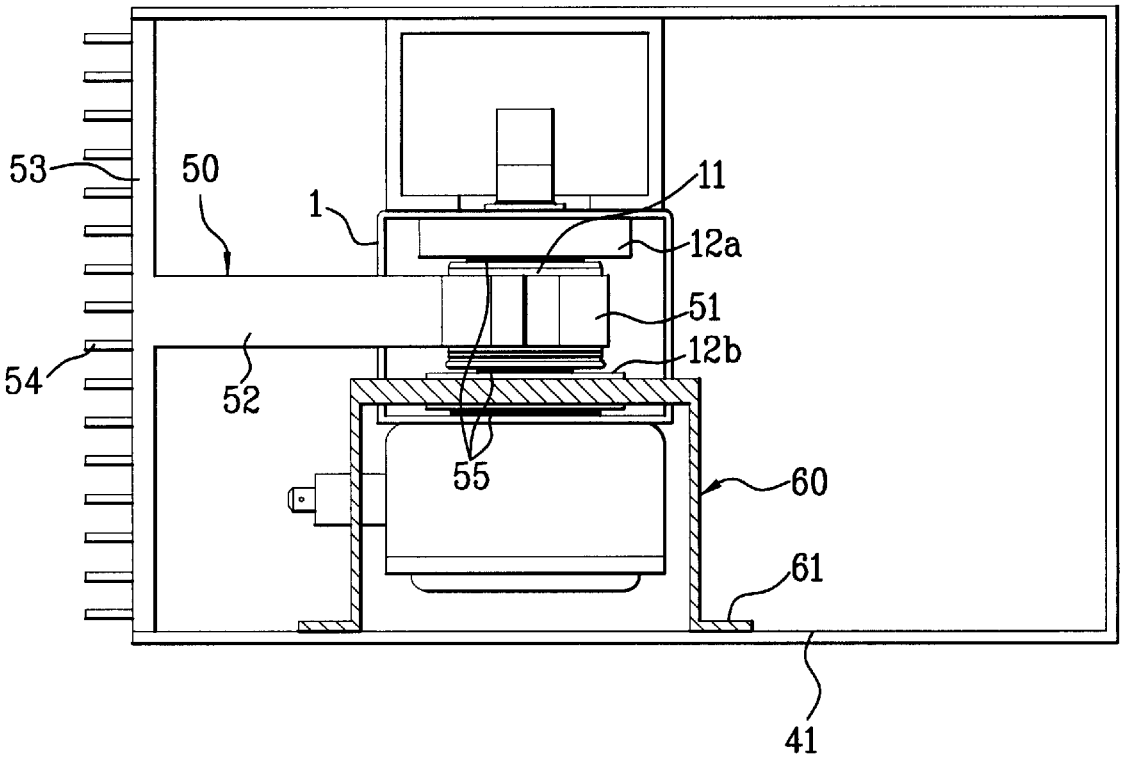
FIG. 10 illustrates a diagram showing an insulating member fitted additionally in a preferred embodiment of the present invention.
Figure 12:
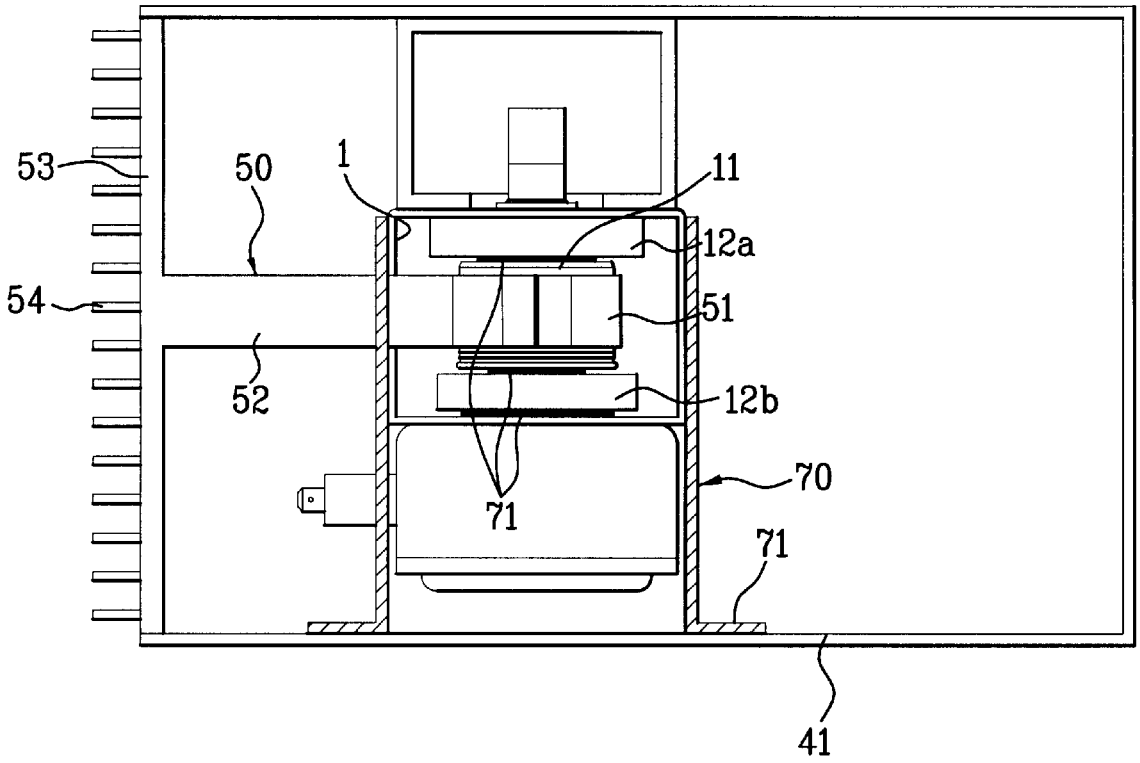
FIG. 12 illustrates a diagram showing an insulating member fitted additionally in another preferred embodiment of the present invention.
Figure 13:
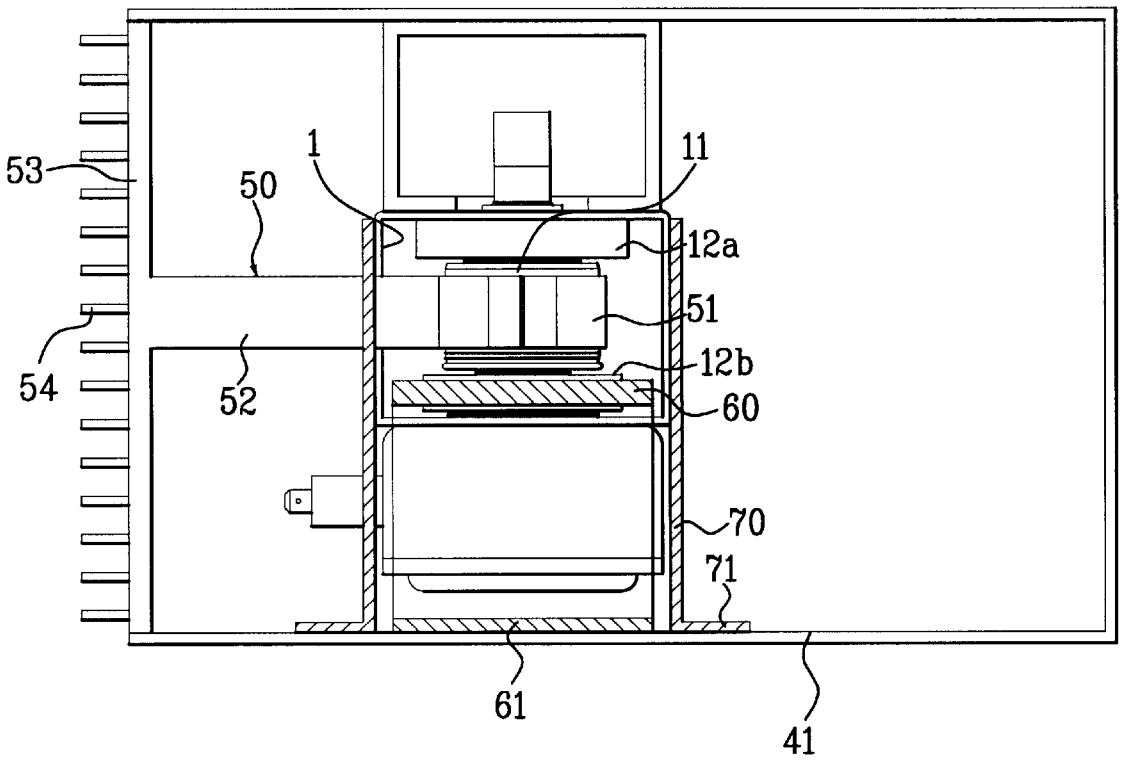
FIG. 13 illustrates a diagram showing an insulating member fitted additionally in another preferred embodiment of the present invention.

The insulating member 55 may be fitted between both ends of the anode 11 and the magnets 12*a* and 12*b*, or between the magnets 12*a* and 12*b* and the yoke 1. Also, the insulating member 55 may be fitted between both ends of the anode 11 and the magnets 12*a* and 12*b*, between the magnets 12*a* and 12*b* and the yoke 1. FIGS. 10, 12 and 13 illustrate the insulating member 55 fitted according to respective embodiments.

Figure 11A:
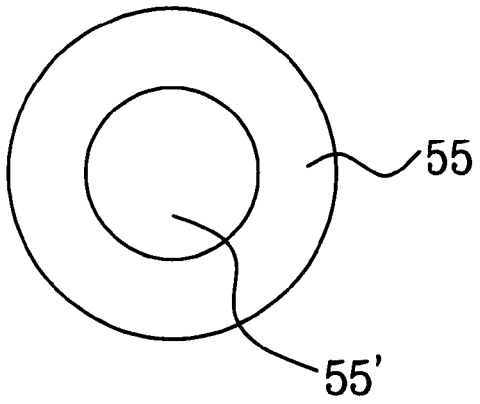
FIGS. 11A–B illustrate a diagram showing an insulating member fitted additionally in another preferred embodiment of the present invention.
Figure 11B:
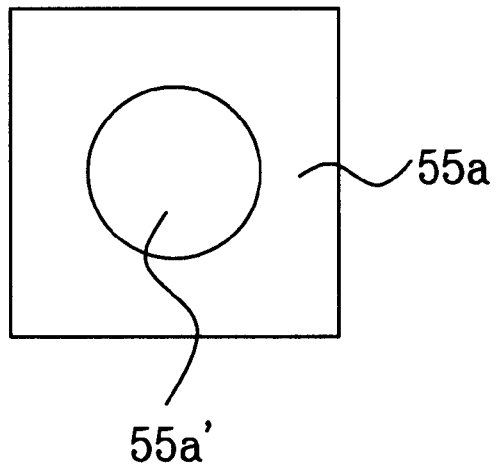

The insulating member 55 may be formed of a material having an excellent insulating property, such as mica, asbestos, and the like, in a disk form with a central hole 55', or a polygonal form with a central hole 55*a*' as shown in FIGS. 11A and 11B. The insulating member 55 or 55*a* is fitted such that an outer circumference of the A seal or F seal is inserted in an inner circumference of the hole 55' or 55*a*'.

The fitting of the insulating member 55 or 55*a* between the anode 11 and the magnets 12*a* and 12*b* and the magnets 12*a* and 12*b* and the yoke 1 prevents temperature rise of the magnets 12*a* and 12*b* caused by a heat transfer, because heat transfer, not only from the anode 11 to the magnets 12*a* and 12*b* directly, but also from the anode 11 to the magnets 12*a* and 12*b* through the yoke 1 indirectly, can be prevented. Accordingly, the embodiment can also prevent the degradation of the magnets 12*a* and 12*b* and the power drift of the magnetron caused by the degradation.

The discharge of heat from the anode 11 to an exterior through the heat discharge path of the anode heat conductor directly, and the discharge of the heat transferred to the magnets 12*a* and 12*b* from the anode 11 to the exterior through the magnet heat conductor 60 and the yoke heat conductor 70 indirectly, not only enhances the cooling capability of the magnetron, but also restricts temperature rise of the magnets 12*a* and 12*b*, effectively.

The fitting of the heat insulating members 55 cuts of heat transfer to the magnets 12*a* and 12*b*, to prevent degradation of the magnets 12*a* and 12*b*.

It is preferable that the heat conductors and the insulating members are provided selectively depending on a capacity of the magnetron, and provided fully only when required for avoiding the system from making complicate unnecessarily.

As has described, the magnetron of the present invention has the following advantages.

First, the heat conductors for cooling the anode, the magnets and the yoke and the insulating members for insulating heat from the magnetron permits to maintain a temperature of the magnet lower than the related art even if an output of a product having the magnetron applied thereto is high, which prevents degradation of the magnets and subsequent power drift of the magnetron, permits to secure functional stability, and to prevent reduction of a lifetime.

Second, the effective cooling of the magnetron only with the naturally circulating air can dispense with the inlet and outlet in the outside case, permitting to provide an enclosed type of outside case, to permit to secure reliability of the magnetron even if the magnetron is applied to a product installed in an outdoor, since no rain drops and the like can not enter into the magnetron.

Third, the elimination of the cooling fan from the magnetron permits elimination of vibration or noise from the source.

Fourth, not only the elimination of the cooling fan, but also the unification of the heat dissipation plate with the outside case, permit reduction of a size of the magnetron even if the present invention is applied to a magnetron of a large capacity.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A magnetron comprising:

a cylindrical anode having a resonant space formed therein and a cathode fitted therein;

magnets fitted to upper and lower sides of the anode;

a yoke fitted on outsides of the anode and the magnets to form a closed circuit; and cooling devices including a main cooling device to form a heat discharge path from the anode, and a supplementary cooling device to form a heat discharge path from the magnet direct or indirectly.

2. The magnetron as claimed in claim 1, wherein the main cooling device is an anode heat conductor having one end closely fitted to an outside surface of the anode, and the other end passed through the yoke and exposed to an external air.

3. The magnetron as claimed in claim 1, wherein the supplementary cooling device includes a magnet heat conductor closely fitted to an outside surface of the magnet, the magnet heat conductor having one side in contact with the outside case of the magnetron.

4. The magnetron as claimed in claim 1, wherein the supplementary cooling device includes a yoke heat conductor closely fitted to an outside surface of a yoke plate, the yoke heat conductor having one side in contact with the outside case of the magnetron.

5. The magnetron as claimed in claim 1, wherein the supplementary cooling device includes;

a magnet heat conductor closely fitted to an outside surface of the magnet, the magnet heat conductor having one side in contact with the outside case of the magnetron, and a yoke heat conductor closely fitted to an outside surface of a yoke plate, the yoke heat conductor having one side in contact with the outside case of the magnetron.

6. The magnetron as claimed in claim 2, wherein the anode heat conductor includes;

a head closely fitted to an outside surface of the anode, an extension from the head to pass through the yoke, and a heat dissipation plate connected to an outside end of the extension and exposed to external air.

7. The magnetron as claimed in claim 6, wherein the head includes at least two members for detachably fitting to surround an outside surface of the anode.

8. The magnetron as claimed in claim 6, further comprising a heat transmission material applied to a part where the outside surface of the anode is in contact with the head.

9. The magnetron as claimed in claim 8, wherein the heat transmission material is a grease.

10. The magnetron as claimed in claim 8, wherein the heat transmission material is a paste.

11. The magnetron as claimed in claim 6, wherein the heat dissipation plate includes a plurality of heat dissipation fins fitted thereto.

12. The magnetron as claimed in claim 11, wherein the heat dissipation fin is a thin and long plate.

13. The magnetron as claimed in claim 6, wherein the heat dissipation plate forms one face of the outside case.

14. The magnetron as claimed in claim 13, wherein the heat dissipation plate includes a plurality of heat dissipation fins fitted thereto.

15. The magnetron as claimed in claim 14, wherein the heat dissipation fin is a thin and long plate.

16. The magnetron as claimed in claim 14, wherein the heat dissipation fin is fitted to an outside surface of the outside case.

17. The magnetron as claimed in claim 2, wherein the anode heat conductor includes;

a head closely fitted to an outside surface of the anode, a heat pipe having one end closely fitted to the head, and the other end passed through the yoke to be positioned at an exterior, and a heat dissipation plate connected to an outside end of the heat pipe and exposed to external air.

18. The magnetron as claimed in claim 17, wherein the head includes at least two members for detachably fitting to surround an outside surface of the anode.

19. The magnetron as claimed in claim 18, wherein the heat pipe has two ends inserted in the head and the heat dissipation plate, respectively.

20. The magnetron as claimed in claim 18, further comprising a heat transmission material applied to a part where the outside surface of the anode is in contact with the head.

21. The magnetron as claimed in claim 1, further comprising insulating members fitted between both ends of the anode and the magnets.

22. The magnetron as claimed in claim 1, further comprising insulating members fitted between the magnets and the yoke.

23. The magnetron as claimed in claim 21, further comprising insulating members fitted between the magnets and the yoke.

* * * * *